United States Patent [19]

Yamaguchi et al.

[11] Patent Number: 4,774,911

[45] Date of Patent: Oct. 4, 1988

[54] COOLING FAN SHROUD MOUNTED ON AN ENGINE VEHICLE

[75] Inventors: Yutaka Yamaguchi; Tatsuya Yamaguchi; Hisao Nagata, all of Kariya, Japan

[73] Assignee: Kabushiki Kaisha Toyoda Jidoshokki Seisakusho, Kariya, Japan

[21] Appl. No.: 905,688

[22] Filed: Sep. 9, 1986

[30] Foreign Application Priority Data

Sep. 14, 1985 [JP] Japan ..... 60-141348[U]

[51] Int. Cl.[4] ..... F01P 5/06

[52] U.S. Cl. ..... 123/41.49; 415/219 R

[58] Field of Search ..... 123/41.49; 415/174, 415/196, 206, 213 C, 219 R, DIG. 1

[56] References Cited

U.S. PATENT DOCUMENTS

| | | | |
|---|---|---|---|
| 2,668,523 | 2/1954 | Lamb | 123/41.49 |
| 3,144,859 | 8/1964 | Walton | 415/219 R |
| 4,213,426 | 7/1980 | Longhouse | 123/41.49 |
| 4,522,160 | 6/1985 | Speers et al. | 123/41.49 |
| 4,541,369 | 9/1985 | Ruhl | 123/41.49 |

*Primary Examiner*—Tony M. Argenbright
*Assistant Examiner*—Eric R. Carlberg
*Attorney, Agent, or Firm*—Brooks Haidt Haffner & Delahunty

[57] ABSTRACT

A cooling fan shroud mounted on an engine vehicle comprises an engine mounting, a radiator mounting and a flexible member made of rubber bellows and connecting the engine mounting and the radiator mounting. The lower portion of the engine mounting is formed in a reverse U-shape, and the lower portion of radiator mounting is formed in a reverse L-shape. The radiator has a support projecting from the lower portion thereof and formed in a U-shape cross section. The reverse L-shaped lower portion of the radiator mounting of the fan shroud is inserted into the U-shaped support projecting from the lower portion of the radiator. The engine has a support formed in a L-shape at the lower portion thereof. The reverse U-shaped lower portion of the engine mounting is inserted onto the L-shaped support of the engine. The upper portions of the engine mounting and radiator mounting of the fan shroud are secured to the engine and the radiator by means of screws.

1 Claim, 1 Drawing Sheet

COOLING FAN SHROUD MOUNTED ON AN ENGINE VEHICLE

TECHNICAL FIELD OF THE INVENTION

The present invention relates to a cooling fan shroud mounted on an engine vehicle, such as an industrial vehicle, for example, a fork lift truck, which is a vehicle used for loading and unloading of vessels in a workshop.

PRIOR ART

Generally speaking, in an engine vehicle, a radiator which cools cooling water in a water-cooled engine is disposed at a position facing the engine, and cooling air flow is generated by means of a cooling fan which is driven by the engine. Further, a fan shroud is secured to the radiator by means of screw bolts, and its circular front end extends to a position adjacent to the cooling fan so that the cooling air generated by the cooling fan can effectively cool the radiator.

PROBLEMS TO BE SOLVED BY THE INVENTION

In such a cooling fan apparatus, there is a problem that a tip clearance, i.e., the clearance between the periphery of the cooling fan and the inner surface of the shroud, is necessarily to be relatively large in order to avoid collision between the periphery of the cooling fan and the inner surface of the shroud, since the fan is vibrated together with the engine.

In addition, when the fan shroud of a conventional structure is required to be removed, the screw bolts which have been threaded to the radiator are unfastened first, and then the fan shroud is removed from the radiator and is moved toward the cooling fan. Thereafter, the fan shroud is unloaded from the engine. Similarly, when the fan shroud is required to be assembled on the engine, similar troublesome operations, which are reverse to those described above, are necessary. Further, it is not easy for an operator to fasten and unfasten a screw bolt used to secure the cooling fan to a driving shaft of the engine, because the fan shroud may disturb the fastening and unfastening operation. Accordingly, there is another problem that the cooling fan and the fan shroud are difficult to be readily serviced when they are assembled and adjusted.

In order to avoid the above-described collision between the cooling fan and the fan shroud and in order to facilitate easy assembling and adjusting of the cooling fan and the fan shroud, the tip clearance is set relatively large in a conventional apparatus. According to the large tip clearance, there causes still another problem that cooling effect can not be high.

OBJECTS OF THE INVENTION

An object of the present invention is to obviate the above-described problems inherent in a conventional apparatus.

Another object of the present invention is to provide a cooling fan shroud mounted on an engine vehicle, which can be readily assembled and disassembled so that a radiator can be easily serviced, for example, cleaned.

A still other object of the present invention is to provide a cooling fan shroud mounted on an engine vehicle, by which a tip clearance can be small so that the advantages of the fan shroud can be large.

SUMMARY OF THE INVENTION

The present invention provides a cooling fan shroud mounted on an engine vehicle characterized in that the fan shroud comprises an engine mounting, a radiator mounting and a flexible member connecting the engine mounting and the radiator mounting, that lower portions of the engine mounting and radiator mounting are engageable with supports projecting from an engine and a radiator, and that upper portions of the engine mounting and radiator mounting can be secured to the engine and the radiator by means of screws.

According to the present invention, the fan shroud comprises an engine mounting, a radiator mounting and a flexible member connecting the engine mounting and the radiator mounting, and the lower portions of the engine mounting and radiator mounting are engageable with supports projecting from an engine and a radiator, and upper portions of the engine mounting and radiator mounting can be secured to the engine and the radiator by means of screws. Therefore, after the screw means are removed from the upper portions of the engine mounting and radiator mounting, the fan shroud is disengaged from the supports projecting from the engine and the radiator. Thus, the fan shroud can be easily removed, and they can be assembled in a manner reverse to that described above.

Furthermore, since the engine mounting is secured to the engine by means of screws according to the present invention, the possibility of the collision between the fan shroud and the cooling fan due to the vibration of the engine can be remarkably lowered. Therefore, the tip clearance can be small according to the present invention.

In addition, since the engine mounting and the radiator mounting of the fan shroud are connected by the flexible member in the present invention, the fan shroud can be gathered toward the radiator. Accordingly, a space formed between the cooling fan and the fan shroud and used to assemble and disassemble the fan shroud can be small.

Due to the small tip clearance and the above-described small space, the fan shroud can tightly seal the space around the cooling fan. Accordingly, the cooling efficiency can be increased.

BRIEF DESCRIPTION OF THE DRAWINGS

The present invention will now be explained in detail with reference to the accompanying drawings, wherein.

PREFERRED EMBODIMENT

Figure 1:
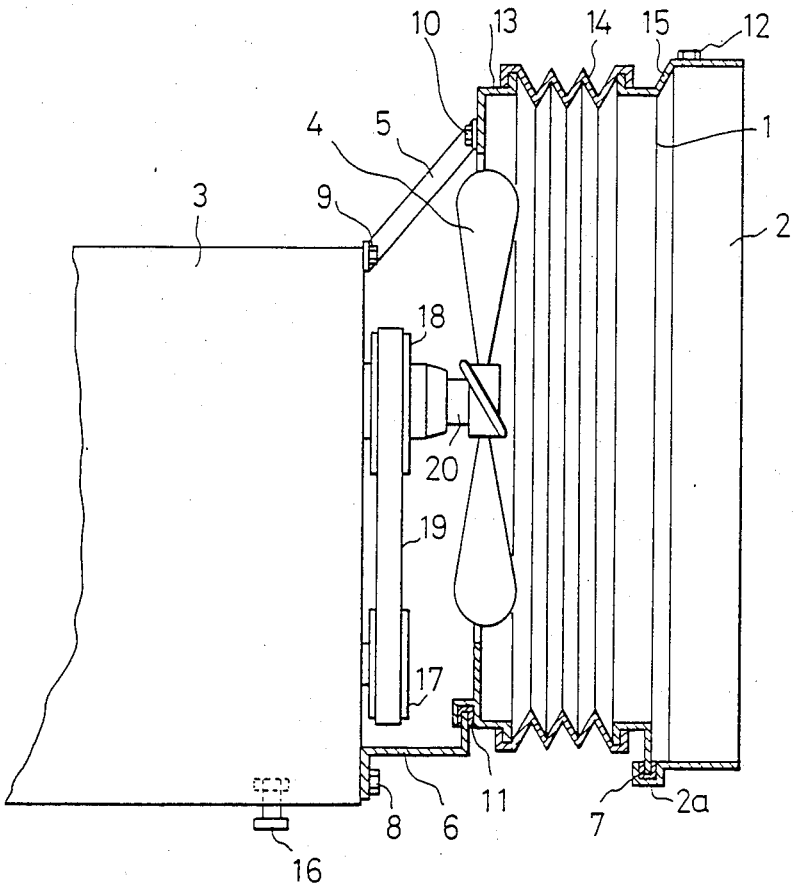
FIG. 1 is a partially cross sectioned side view of an embodiment of the present invention.

Referring to FIG. 1, an internal combustion engine 3 is elastically supported on a frame of a vehicle (not shown) by means of a mount insulator 16 made of an elastic material. A V-belt 19 is engaged between a crank pulley 17 driven by the engine 3 and a fan pulley 18 mounted on a spindle 20 so as to drive the spindle 20 with a cooling fan 4.

A radiator 2 of a conventionally known construction is secured to the frame of the vehicle in such a manner that it faces the fan 4 of the engine 3. The radiator 2 has a hook 2*a* of a U-shape cross section secured, for example by means of welding, to the lower portion thereof to form a support. The radiator 2 has threaded holes formed at the upper portion thereof which holes are used to secure bolts 12. The radiator 2 may have stays secured thereto, which may have threaded holes used to secure bolts.

Figure 2:
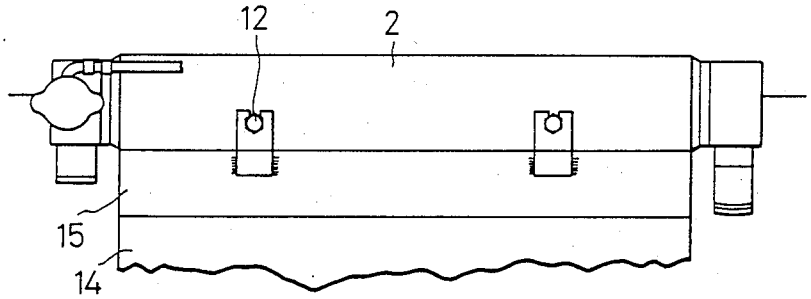
FIG. 2 is a plan view of FIG. 1.

A fan shroud 1 is formed as a circular cylinder and is disposed at a position between the radiator 2 and the engine 3. More specifically, the fan shroud has a projection formed in a reverse L-shape at the lower portion of a radiator mounting 15 thereof, and the lower portion is inserted into the hook 2*a* having an insulator 7 made of a suitable elastic material therebetween. The upper portion of the radiator mounting 15 is put onto the upper portion of the radiator 2 and is secured there by means of a plurality of bolts 12 as illustrated in FIG. 2.

The engine 3 has a stay 5 inclined upwardly and secured to the upper portion thereof by bolts 9 and has a bracket 6 secured to the lower portion thereof by bolts 8. The stay 5 has through holes for inserting bolts 10, and the front end of the bracket 6 extends upwardly.

The lower portion of the engine mounting 13 of the fan shroud 1 is formed in a reverse U-shape, and the lower portion is inserted onto the front end of the bracket 6 having an insulator 11 made of a suitable elastic material therebetween. The upper portion of the engine mounting 13 is secured to the stay 5 by means of the bolts 10.

The front end (the left end in FIG. 1) of the engine mounting 13 of the fan shroud 1 is bent inwardly, and the inner periphery of the inwardly bent front end is formed in an arc to have a small clearance between the outer periphery of the cooling fan 4 and so as to prevent from being collided therewith. A flexible member 14 is made of rubber bellows and connects the radiator mounting 15 and the engine mounting 13 of the fan shroud 1.

Since the fan shroud of the present invention is constructed as described above, the fan shroud 1 can be moved towards the radiator because of the flexibility of the flexible member 14 if the bolts 10 and 12 are unfastened. Accordingly, the fan shroud 1 can be passed by the front end of the fan 4 and can be removed from the radiator 2, even when the cooling fan 4 is kept on the spindle 20. Further, when the fan shroud 1 is assembled, it can be assembled passing by the cooling fan 4.

ADVANTAGES OF THE INVENTION

According to the present invention, the fan shroud comprises an engine mounting, a radiator mounting and a flexible member connecting the engine mounting and the radiator mounting, and the lower portions of the engine mounting and radiator mounting are engageable with supports projecting from an engine and a radiator, and upper portions of the engine mounting and radiator mounting can be secured to the engine and the radiator by means of screws. Therefore, after the screw means are removed from the upper portions of the engine mounting and radiator mounting, the fan shroud is disengaged from the supports projecting from the engine and the radiator. Thus, the fan shroud can be easily removed, and they can be assembled in a manner reverse to that described above.

Furthermore, since the engine mounting is secured to the engine by means of the screws according to the present invention, the possibility of a collision between the fan shroud and the cooling fan due to the vibration of the engine can be remarkably lowered. Therefore, the tip clearance can be small according to the present invention.

In addition, since the engine mounting and the radiator mounting of the fan shroud are connected by the flexible member in the present invention, the fan shroud can be gathered toward the radiator. Accordingly, a space formed between the cooling fan and the fan shroud and used to assemble and disassemble the fan shroud can be small.

Due to the small tip clearance and the above-described small space, the fan shroud can tightly seal the space around the cooling fan, and accordingly, the cooling efficiency can be increased.

What is claimed is:

1. An easily removable cooling fan shroud adapted to be mounted between an engine and a radiator of an engine vehicle, comprising a rigid engine mounting, a rigid radiator mounting, and a flexible member formed as a circular cylindrical bellows normally extending between and connecting said engine mounting and said radiator mounting; wherein said bellows is spaced and separated from free ends of blades of a cooling fan, and said bellows extends from the radiator mounting to substantially a plane of rotation of said cooling fan and said bellows is axially compressible for removal of the cooling fan shroud through a space between said radiator and said cooling fan, lower portions of said engine mounting and said radiator mounting being engageable by slidably releasable U-shaped hook means with supports projecting from said engine and said radiator, upper portions of said engine mounting and said radiator mounting being secureable to said engine and said radiator by means of bolts.

* * * * *